US008006468B2

(12) United States Patent
Bassani

(10) Patent No.: US 8,006,468 B2
(45) Date of Patent: Aug. 30, 2011

(54) CONTAINER FILLING MACHINE HAVING VIBRATION TRAYS

(75) Inventor: Loris Bassani, Montreal (CA)

(73) Assignee: Countlab Inc., Montreal-Nord, Quebec (CA)

( * ) Notice: Subject to any disclaimer, the term of this patent is extended or adjusted under 35 U.S.C. 154(b) by 144 days.

(21) Appl. No.: 12/102,585

(22) Filed: Apr. 14, 2008

(65) Prior Publication Data

US 2009/0255948 A1 Oct. 15, 2009

(51) Int. Cl.
*B65B 5/10* (2006.01)
*B65B 1/08* (2006.01)

(52) U.S. Cl. ..... 53/475; 53/500; 53/241; 53/248; 53/250; 221/1

(58) Field of Classification Search ..... 53/473, 53/475, 500, 235, 241, 247, 248, 250; 221/1, 221/200, 201, 202
See application file for complete search history.

(56) References Cited

U.S. PATENT DOCUMENTS

| | | | | |
|---|---|---|---|---|
| 1,383,623 | A * | 7/1921 | Groves | 53/493 |
| 2,845,759 | A * | 8/1958 | Cote et al. | 53/495 |
| 3,028,713 | A * | 4/1962 | Kennedy et al. | 53/251 |
| 3,081,588 | A | 3/1963 | Klapes et al. | |
| 3,139,713 | A * | 7/1964 | Merrill et al. | 53/55 |
| 3,677,437 | A * | 7/1972 | Haigler | 221/7 |
| 3,746,211 | A | 7/1973 | Burgess, Jr. | |
| 3,917,050 | A * | 11/1975 | Gregor | 198/358 |
| 3,925,960 | A * | 12/1975 | Saari et al. | 53/167 |
| 4,408,295 | A * | 10/1983 | Kavage et al. | 250/559.4 |
| 4,461,363 | A | 7/1984 | Loy | |
| 4,680,464 | A * | 7/1987 | Bross | 250/223 R |
| 4,922,181 | A | 5/1990 | Pullan | |
| 4,924,955 | A | 5/1990 | Dauge | |
| 4,932,559 | A | 6/1990 | Stein | |
| 4,943,227 | A | 7/1990 | Facchini | |
| 5,200,013 | A | 4/1993 | Traber | |

(Continued)

FOREIGN PATENT DOCUMENTS

CA 2060784 8/1992

(Continued)

OTHER PUBLICATIONS

"PCT International Search Report" for International Application No. PCT/CA2007/000238, filed on Feb. 16, 2007, mailed on Nov. 11, 2007, 6 pages.

(Continued)

*Primary Examiner* — Paul Durand

(57) ABSTRACT

A container-filling machine for placing discrete articles within at least one container. The container filling machine comprises at least one vibration tray comprising a discrete article receiving end, a discrete article drop-off end and a plurality of channels extending from the discrete article receiving end to the discrete article drop-off end. Each channel includes two discrete article receiving paths at the discrete article receiving end. The two discrete article receiving paths combine into a single discrete article-depositing path in proximity to the discrete article drop-off end. The vibration tray is operative for moving discrete articles from the discrete article-receiving end to the discrete article drop-off end along the plurality of channels. The container filling machine further comprises a plurality of sloped paths for receiving the discrete articles from the discrete article drop-off end of the at least one vibration tray. The plurality of sloped paths leading the discrete articles towards the at least one container.

21 Claims, 7 Drawing Sheets

U.S. PATENT DOCUMENTS

| | | | | |
|---|---|---|---|---|
| 5,238,124 | A | | 8/1993 | Cane et al. |
| 5,333,778 | A | | 8/1994 | Specker |
| 5,463,839 | A | * | 11/1995 | Stange et al. ..... 53/54 |
| 5,489,019 | A | * | 2/1996 | DiNanno et al. ..... 198/752.1 |
| 5,585,732 | A | | 12/1996 | Steele et al. |
| 5,596,865 | A | | 1/1997 | Kramer |
| 5,737,902 | A | | 4/1998 | Aylward |
| 5,931,286 | A | | 8/1999 | Illi |
| 5,950,404 | A | | 9/1999 | Meyer et al. |
| 6,185,901 | B1 | | 2/2001 | Aylward |
| 6,266,946 | B1 | | 7/2001 | Aylward |
| 6,269,612 | B1 | | 8/2001 | Aylward |
| 6,401,429 | B2 | | 6/2002 | Aylward |
| 6,494,022 | B1 | | 12/2002 | Aylward |
| 6,504,387 | B1 | | 1/2003 | Shail et al. |
| 6,505,460 | B2 | | 1/2003 | Aylward |
| 6,625,955 | B2 | | 9/2003 | Aylward |
| 6,640,842 | B1 | | 11/2003 | Laukenmann et al. |
| 6,681,550 | B1 | | 1/2004 | Aylward |
| 6,755,008 | B2 | | 6/2004 | Schmetzer et al. |
| 6,789,780 | B2 | | 9/2004 | Pieri |
| 6,799,413 | B2 | | 10/2004 | Aylward |
| 6,925,782 | B2 | | 8/2005 | Aylward |
| 6,929,115 | B2 | | 8/2005 | Monti |
| 6,932,210 | B2 | | 8/2005 | Krämer |
| 6,971,216 | B2 | | 12/2005 | Monti |
| 7,007,821 | B2 | | 3/2006 | Aylward |
| 7,012,242 | B2 | | 3/2006 | Tarozzi et al. |
| 7,025,207 | B2 | | 4/2006 | Breu et al. |
| 7,066,350 | B2 | | 6/2006 | Aylward |
| 7,107,741 | B2 | | 9/2006 | Monti |
| 7,121,410 | B2 | | 10/2006 | Rohrmus et al. |
| 7,124,912 | B2 | | 10/2006 | Aylward |
| 7,128,100 | B2 | | 10/2006 | Monti |
| 7,331,540 | B2 | | 2/2008 | Klaumünzer |
| 2001/0045081 | A1 | | 11/2001 | Aylward |
| 2002/0023414 | A1 | | 2/2002 | Aylward |
| 2002/0108356 | A1 | | 8/2002 | Aylward |
| 2002/0166790 | A1 | | 11/2002 | Aylward |
| 2002/0194815 | A1 | | 12/2002 | Aylward |
| 2004/0007442 | A1 | | 1/2004 | Monti |
| 2004/0035878 | A1 | | 2/2004 | Aylward |
| 2004/0123560 | A1 | | 7/2004 | Monti |
| 2004/0123561 | A1 | | 7/2004 | Monti |
| 2004/0128955 | A1 | | 7/2004 | Aylward |
| 2004/0139695 | A1 | | 7/2004 | Monti |
| 2005/0000192 | A1 | | 1/2005 | Aylward |
| 2005/0077313 | A1 | | 4/2005 | Aylward |
| 2005/0189373 | A1 | | 9/2005 | Aylward |
| 2005/0217208 | A1 | | 10/2005 | Cicognani |
| 2005/0230001 | A1 | | 10/2005 | Monti |

FOREIGN PATENT DOCUMENTS

| | | | |
|---|---|---|---|
| CA | 2321725 | | 9/1999 |
| DE | 4 118 878 | | 1/1993 |
| DE | 4331879 | | 3/1994 |
| DE | 202004008975 | U1 | 9/2004 |
| DE | 102004027590 | B3 | 11/2005 |
| EP | 0 259 354 | | 3/1988 |
| EP | 0347392 | | 12/1989 |
| EP | 0360765 | | 3/1990 |
| EP | 0486439 | | 5/1992 |
| EP | 0491658 | | 6/1992 |
| EP | 0499577 | | 8/1992 |
| EP | 0561737 | | 9/1993 |
| EP | 0588838 | | 3/1994 |
| EP | 0588993 | | 3/1994 |
| EP | 0618447 | | 10/1994 |
| EP | 0630816 | | 12/1994 |
| EP | 0639528 | | 2/1995 |
| EP | 0677482 | | 10/1995 |
| EP | 0770554 | | 5/1997 |
| EP | 0816235 | | 1/1998 |
| EP | 0 932 554 | | 8/1999 |
| EP | 1041022 | | 10/2000 |
| EP | 1043252 | | 10/2000 |
| EP | 1052202 | | 11/2000 |
| EP | 1060362 | | 12/2000 |
| EP | 1061361 | | 12/2000 |
| EP | 1106511 | | 6/2001 |
| EP | 1171347 | | 1/2002 |
| EP | 1221410 | | 7/2002 |
| EP | 1251073 | | 10/2002 |
| EP | 1253095 | | 10/2002 |
| EP | 1270441 | | 1/2003 |
| EP | 1380510 | | 1/2004 |
| EP | 1389583 | | 2/2004 |
| EP | 1391386 | | 2/2004 |
| EP | 1395500 | | 3/2004 |
| EP | 1413517 | | 4/2004 |
| EP | 1431180 | | 6/2004 |
| EP | 1431181 | | 6/2004 |
| EP | 1431182 | | 6/2004 |
| EP | 1471993 | | 11/2004 |
| EP | 1481913 | | 12/2004 |
| EP | 1588944 | | 10/2005 |
| EP | 1602593 | | 12/2005 |
| GB | 2270771 | | 3/1994 |
| GB | 2310729 | | 9/1997 |
| GB | 2326488 | | 12/1998 |
| JP | 01210200 | A | 8/1989 |
| JP | 04352669 | A | 12/1992 |
| JP | 05228447 | A | 9/1993 |
| JP | 06032347 | A | 2/1994 |
| JP | 2000/079912 | | 3/2000 |
| JP | 2000073312 | A | 3/2000 |
| JP | 2002249103 | A | 9/2002 |
| WO | WO 87/04407 | | 7/1987 |
| WO | WO 92/22278 | | 12/1992 |
| WO | WO 92/22401 | | 12/1992 |
| WO | WO 95/09452 | | 4/1995 |
| WO | WO 96/25333 | | 8/1996 |
| WO | WO 96/26873 | | 9/1996 |
| WO | WO 97/01489 | | 1/1997 |
| WO | WO 97/06061 | | 2/1997 |
| WO | WO 97/19010 | | 5/1997 |
| WO | WO 98/15461 | | 4/1998 |
| WO | WO 98/57144 | | 12/1998 |
| WO | WO 99/45343 | | 9/1999 |
| WO | WO 99/62699 | | 12/1999 |
| WO | WO 00/64744 | | 11/2000 |
| WO | WO 02/100736 | | 12/2002 |
| WO | WO 03/097459 | | 11/2003 |
| WO | WO 2005/023672 | | 3/2005 |

OTHER PUBLICATIONS

"Patent Search Report", prepared by Landon IP, Inc., Alexandria, VA, Order No. 63498, 6 pages, undated.

"Patent Search Report", prepared by Landon IP, Inc., Alexandria, VA, Order No. 63498, 14 pages, undated.

* cited by examiner

CONTAINER FILLING MACHINE HAVING VIBRATION TRAYS

FIELD OF THE INVENTION

The present invention relates to container filling machines, and specifically to container filling machines having vibration trays that comprise channels with dividing walls included therein.

BACKGROUND OF THE INVENTION

Packaging machines for filling containers with discrete articles (such as pharmaceutical pills, cosmetic items, hardware components, candies, nuts, etc. . . . ) are known in the art. Such container filling machines are able to take a large supply of discrete articles and to transport them towards a container, while ensuring that a desired number of the discrete articles are placed within the container. However, existing container filling machines are plagued with numerous deficiencies that often render them ineffective and inefficient.

Existing container filling machines for placing discrete articles within containers typically use a vibration tray in order to space the discrete articles from each other and move the discrete articles towards multiple paths that ultimately lead towards the containers. However, the speed at which such vibration trays can move the discrete articles forward is generally quite limited. This makes the container filling machine less efficient than it could potentially be.

In light of the above, there is a need in the industry for an improved container filling machine that alleviates, at least in part, the deficiencies of existing container filling machines.

SUMMARY OF THE INVENTION

In accordance with a first broad aspect, the present invention provides a container filling machine for placing discrete articles within at least one container. The container filling machine comprises at least one vibration tray comprising a discrete article receiving end, a discrete article drop-off end and a plurality of channels extending from the discrete article receiving end to the discrete article drop-off end. Each channel comprises a wall-portion that divides the channel in two along a longitudinal length of the channel, thereby creating within the channel a first side and a second side. The vibration tray is operative for moving discrete articles from the discrete article-receiving end to the discrete article drop-off end along the plurality of channels. The container filling machine further comprises a plurality of sloped paths for receiving the discrete articles from the discrete article drop-off end of the at least one vibration tray; the plurality of sloped paths leading the discrete articles towards the at least one container.

In accordance with a second broad aspect, the present invention provides a method for filling at least one container with discrete articles. The method comprises providing at least one vibration tray comprising a discrete article receiving end, a discrete article drop-off end and a plurality of channels extending from the discrete article receiving end to the discrete article drop-off end. Each channel comprises a wall-portion that divides the channel in two along a longitudinal length of the channel, thereby creating within the channel a first side and a second side. The method further comprises depositing the discrete articles onto the discrete article receiving end of the vibration tray such that the discrete articles are positioned within both the first side and the second side of each channel. The method further comprises causing the vibration tray to vibrate in order to move the discrete articles from the discrete article receiving end to the discrete article drop-off end along the first side and the second side of each channel, and providing a plurality of sloped paths for receiving the discrete articles from the discrete article drop-off end of the at least one vibration tray. The plurality of sloped paths leading the discrete articles towards at least one container to be filled.

In accordance with a third broad aspect, the present invention provides a vibration tray for use within a container filling machine that is operative for placing discrete articles within at least one container. The vibration tray comprises a discrete article receiving end for receiving discrete articles from a discrete article dispensing device, a discrete article drop-off end for providing the discrete articles to further components of the container filling machine and a plurality of channels extending from the discrete article receiving end to the discrete article drop-off end. Each channel comprises a wall-portion that divides the channel in two along a longitudinal length of the channel, thereby creating within the channel a first side and a second side, wherein the vibration tray is operative for moving discrete articles from the discrete article receiving end to the discrete article drop-off end along the plurality of channels.

In accordance with a fourth broad aspect, the present invention provides a container filling machine for placing discrete articles within at least one container. The container filling machine comprises at least two vibration trays corresponding to respective containers to be filled. Each one of the at least two vibration trays comprises a discrete article receiving end and a discrete article drop-off end. The vibration of the at least two vibration trays causes discrete articles to move from the discrete article receiving end to the discrete article drop-off end of the respective vibration trays. The vibration of each of the at least two vibration trays is controlled independently. The container filling machine further comprises a counting device for providing information indicative of a number of discrete articles that are being supplied from the at least two vibration trays to the respective containers to be filled, and a processing unit in communication with the counting device and the at least two vibration trays. The processing unit being operative for adjusting the frequency of vibration of at least one of the at least two vibration trays at least in part on the basis of the information provided by the counting device.

In accordance with a fifth broad aspect, the present invention provides a method used by a container-filling machine for filling containers with discrete articles. The container-filling machine comprises at least two vibration trays each associated to a respective container to be filled. Each of the at least two vibration trays comprises a discrete article receiving end and a discrete article drop-off end. The vibration of the at least two vibration trays causes discrete articles to move from the discrete article receiving end to the discrete article drop-off end of the respective vibration tray. The method further comprises obtaining information indicative of the rate at which the respective containers are being filled with discrete articles, determining, at least in part on the basis of the information whether one of the respective containers is being filled at a different rate than other ones of the respective containers, and upon determination of at least one of the respective containers being filled at a different rate than the other ones of the respective containers, causing adjustment of the frequency of vibration of the vibration tray corresponding to the at least one of the respective containers.

In accordance with a sixth broad aspect, the present invention provides a container-filling machine for placing discrete articles within at least one container. The container filling machine comprises at least one vibration tray comprising a discrete article receiving end, a discrete article drop-off end and a plurality of channels extending from the discrete article receiving end to the discrete article drop-off end. Each channel includes two discrete article receiving paths at the discrete article receiving end. The two discrete article receiving paths combine into a single discrete article-depositing path in proximity to the discrete article drop-off end. The vibration tray is operative for moving discrete articles from the discrete article-receiving end to the discrete article drop-off end along the plurality of channels. The container filling machine further comprises a plurality of sloped paths for receiving the discrete articles from the discrete article drop-off end of the at least one vibration tray. The plurality of sloped paths leading the discrete articles towards the at least one container.

Other aspects and features of the present invention will become apparent to those ordinarily skilled in the art upon review of the following description of specific embodiments of the invention in conjunction with the accompanying figures.

DETAILED DESCRIPTION

Figure 1:
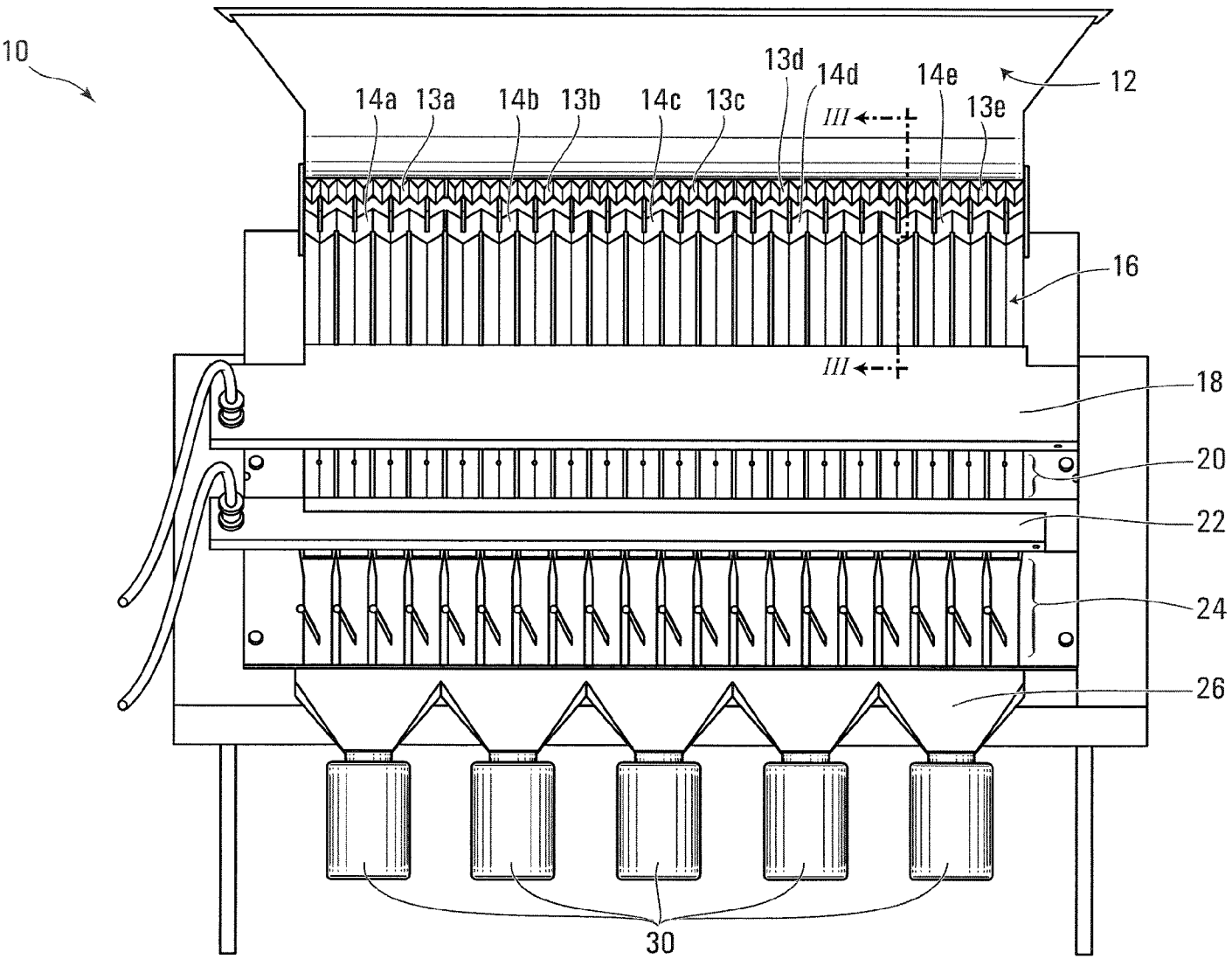
FIG. 1 shows a front plan view of a container filling machine in accordance with a non-limiting example of implementation of the present invention.

Shown in FIG. 1 is a front view of a container-filling machine 10 in accordance with a non-limiting example of implementation of the present invention. The container filling machine 10 is suitable for loading into containers any discrete articles, such as articles for personal treatment (e.g. pharmaceutical pills, cosmetic items, etc) or candies, nuts, or any other type of discrete article. As used herein, the term "discrete article for personal treatment" includes any type of pharmaceutical discrete article that can be ingested (such as pressed-powder or gel cap pills, among other possibilities) as well as any cosmetic item that can be applied to an external part of the body (such as moisturizer capsules, for example).

In the non-limiting embodiment shown, the container filling machine 10 includes a hopper 12, guiding trays 13*a*-13*e*, vibration trays 14*a-e,* a plurality of guiding paths 16, a sensing device 18, a rejection device 20, a counting device 22, a plurality of path blocking devices 24, and a set of funnels 26 for guiding the discrete articles into respective containers 30. In operation, the discrete articles that are to be put into the containers 30 are first supplied to the hopper 12 in a disorganized fashion. For example, a supply of discrete articles can simply be poured or dumped into the hopper 12 from another container. The hopper 12 then deposits the discrete articles onto the vibration trays 14*a*-14*e*, via a series of guides 13*a*-13*e* (best shown in FIG. 2). Once the discrete articles have been deposited onto the guiding trays 13*a*-13*e* and vibration trays 14*a*-14*e*, the guiding trays 13*a*-13*e* and the vibration trays 13*a*-13*e* and 14*a*-14*e* vibrate in order to transport the discrete articles towards the guiding paths 16. The vibration trays 14*a*-14*e* cause the discrete articles to be provided to the guiding paths 16 in a quasi-uniform, spaced-apart manner.

Once deposited onto the guiding paths 16 from the vibration trays 14*a*-14*e*, the discrete articles travel along the guiding paths 16 under the force of gravity. As they travel along the guiding paths 16, the discrete articles first pass through the sensing device 18, which is operative for assessing the integrity of each discrete article on an individual basis. As used herein, the term "assessing the integrity of the discrete articles refers to detecting whether or not a discrete article is defective. An integrally formed discrete article is a non-defective discrete article that is complete and fully formed. As such, by assessing the integrity of the discrete article, the sensing device 18 is verifying whether the discrete article is chipped, broken, deformed or empty in the case of gel cap pills. The sensing device 18 may be an optical sensing device, as is known in the art, or a capacitive sensing device, as described in co-pending PCT application PCT/CA2007/000238.

In the case where a discrete article travelling through the sensing device 18 is found to be defective, the rejection device 20, which is positioned below the sensing device 18, is able to remove the defective discrete article from continued travel towards a container. In accordance with a non-limiting embodiment, the rejection device 20 uses a jet of compressed air that blows through a hole in a guiding path 16 in order to blow a defective discrete article out of its path of travel. Such a rejection device is described in more detail in co-pending application PCT/CA2007/000238.

In the case where a discrete article for personal treatment is not defective, it continues along its guiding path 16 towards the counting device 22. The counting device 22 is operative for counting the number of integral discrete articles that pass therethrough. The counting device 22 can include optical circuitry, or capacitive circuitry in order to detect and generate a count of the discrete articles passing along each one of the respective guiding paths 16. A counting device 22 that is suitable for use within the container filling machine 10 is described in more detail in co-pending application PCT/CA2007/000238. On the basis of information from the counting device 22, the path blocking devices 24, which follow the counting device 22, can control the number of discrete articles that enter each container 30. In a non-limiting embodiment, the path blocking devices 24 are gates that are able to move between an open position and a closed position for blocking access to the containers 30. In the non-limiting embodiment shown, there is one path-blocking device 24 for each of the guiding paths 16.

Using the above components, the container-filling machine 10 is able to fill a plurality of containers 30 with an exact number of integral discrete articles. The path blocking devices 24 further permit the container filling machine 10 to keep a steady flow of discrete articles for personal treatment travelling towards the containers 30, even as filled containers 30 are being replaced by empty containers.

Once filled, the containers 30 continue towards other machines that put caps on the containers 30, apply labels to the containers 30, and generally perform any other operation on the containers 30 that is required prior to providing the containers 30 to an end consumer.

It should be appreciated that numerous discrete articles for personal treatment travel through the guiding paths 16 at the same time, such that once the discrete articles are flowing through the machine, each of the functionalities described above is performed at substantially the same time. For example, while the guiding trays 13*a*-13*e* and the vibration trays 14*a*-14*e* transport certain discrete articles, the sensing device 18 may be sensing other discrete articles that are further on in their travel towards a container 30, and the counting device 22 may be counting still other discrete articles that are even further along in their travel towards a container 30. As such, these functionalities all occur simultaneously while discrete articles travel through the container-filling machine 10.

In a preferred embodiment, the functionality of the components of the container filling machine 10 (e.g. the functionality of the guiding trays 13*a*-13*e*, the vibration trays 14*a*-14*e*, the sensing device 18, the rejection device 20, the counting device 22 and the path blocking devices 24) are controlled via one or more computing units that include at least one software driven processing unit. This will be described in more detail below. However, in some embodiments of the invention, all or part of the functionality of these components, may be implemented as pre-programmed hardware or firmware elements (e.g., application specific integrated circuits (ASICs), electrically erasable programmable read-only memories (EEPROMs), etc.) or other related components.

The guiding trays 13*a*-13*e* and the vibration trays 14*a*-14*e* will now be described in more detail herein.

As described above, the hopper 12 is operative for receiving an initial load of discrete articles, and for releasing those discrete articles onto the plurality of guiding trays 13*a*-13*e* and vibration trays 14*a*-14*e*. The initial load of discrete articles can be placed into the hopper 12 in a quick manner, such as by pouring or dumping the discrete articles at an intake end 32 of the hopper. The discrete articles do not need to be provided to the hopper 12 in any particular order or orientation, and as such can be quickly poured into the hopper 12. This can be done either manually by an operator of the container-filling machine 10, or mechanically by a different machine.

Figure 2:
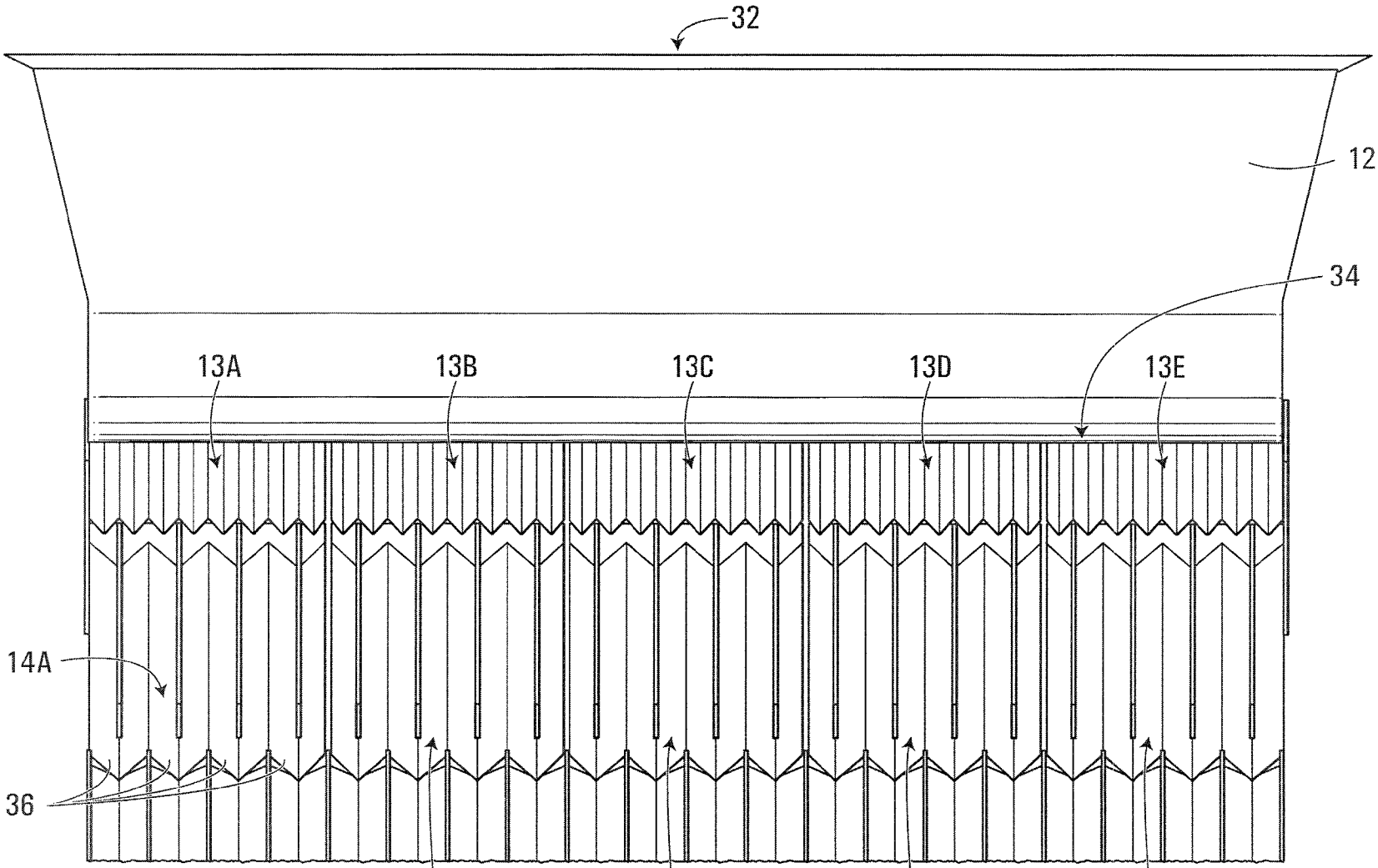
FIG. 2 shows an enlarged front plan view of an upper portion of the container filling machine of FIG. 1.

Although not shown in the Figures, the back portion of the hopper 12 can include an adjustable gate portion, such that the output through which the discrete articles exit the hopper 12 onto the guiding trays 13*a*-13*e* can be adjusted in size. For example, the adjustable gate portion can adjust the size of the output to make it smaller or larger in order to facilitate the depositing of discrete articles of different sizes onto the guiding trays 13*a*-13*e*. As shown in FIG. 2, at the output end 34 of the hopper 12 are included a plurality of guiding trays 13*a*-13*e* that receive the discrete articles from the hopper 12 and transfer the discrete articles onto the vibration trays 14*a*-14*e*.

In accordance with the non-limiting example of implementation shown in the Figures, and as will be described herein, the container-filling machine 10 of the present invention includes five guiding trays 13*a* through 13*e* and five vibration trays 14*a* through 14*e*. It should, however, be appreciated that any number of guiding trays and vibration trays could be used without departing from the spirit of the invention. As will be described in more detail below, the container-filling machine 10 of the present invention includes one guiding tray and one vibration tray for each of the containers 30 to be filled. As such, there is a one-to-one ratio of guiding trays 13*a*-13*e* and vibration trays 14*a*-14*e* to containers 30.

Figure 3:
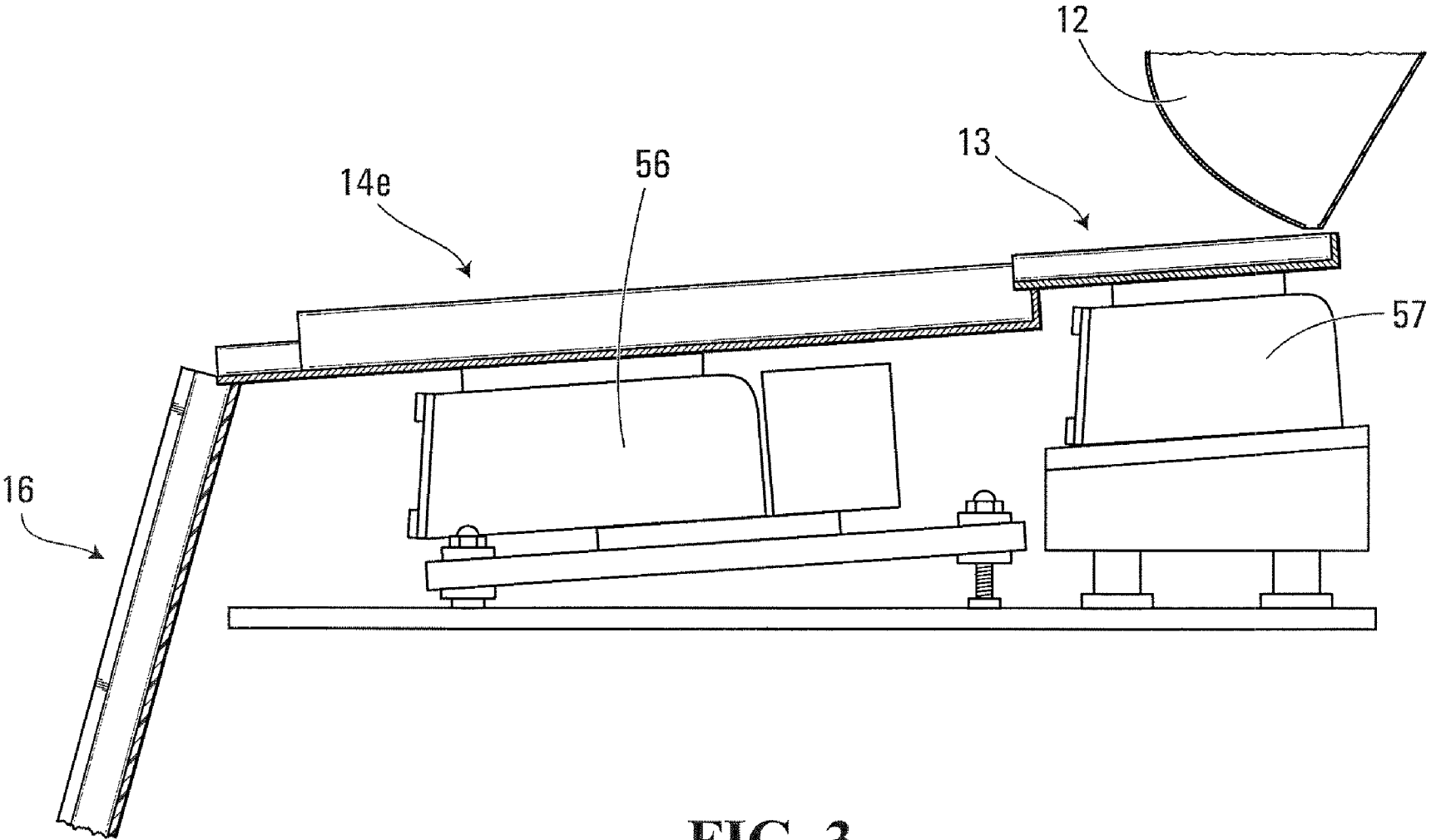
FIG. 3 shows a side representational view of the upper portion of the container filling machine of FIG. 1.

As shown in FIG. 3, positioned beneath the guiding trays 13*a*-13*e* are drive units 57 and positioned beneath vibration trays 14*a*-14*e* are drive units 56. As such, although not shown in FIG. 3, there are a total of five drive units 57, with one drive unit 57 positioned beneath each one of the five guiding trays 13*a*-13*e* respectively, and a total of five drive units 56, with one drive unit 56 positioned beneath each one of vibration trays 14*a*-14*e*. As such, in accordance with the present invention, each of the guiding trays 13*a*-13*e* is in communication with a separate drive unit 57 and each of vibration trays 14*a*-14*e* is in communication with a separate drive unit 56, such that the vibration of each guiding tray 13*a*-13*e* and each vibration tray 14*a*-14*e* can be controlled independently. These drive units 56 and 57 can be either electromagnetic drive units, pneumatic drive units or mechanical drive units, among other possibilities. The drive units 56 and 57 are attached to spring systems (not shown), and/or resilient plates (not shown) for transmitting vibration from the drive units 57, 56 to the guiding vibration trays 14*a*-14*e*. The control of the guiding trays 13*a*-13*e* and the vibration trays 14*a*-14*e* will be described in more detail below.

Figure 4:
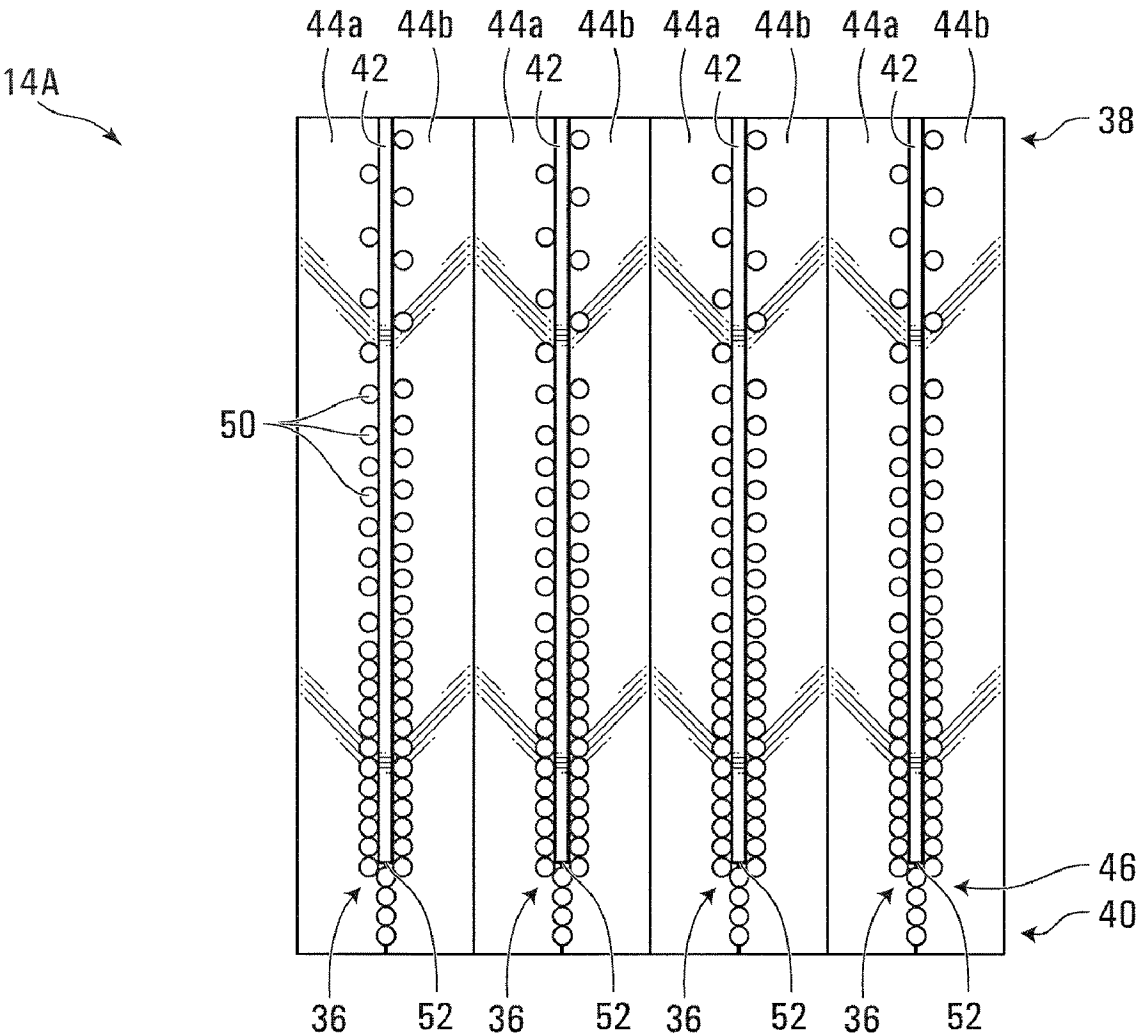
FIG. 4 shows a top plan view of a vibration tray in accordance with a non-limiting example of implementation of the present invention.

As shown in FIG. 4, each of the vibration trays 14*a* through 14*e* includes a discrete article receiving end 38, a discrete article drop-off end 40 and four channels 36 extending from the discrete article receiving end 38 to the discrete article drop off end 40. As shown in FIG. 3, the vibration trays 14*a*-14*e* are positioned substantially horizontally, with a slight downward incline towards the guiding pathways 16. As such, vibration of the trays 14*a*-14*e* causes the discrete articles 50 that are deposited onto the discrete article receiving end 38 of the trays 14*a*-14*e* to move towards the discrete article drop-off end 40 of the trays 14*a*-14*e*. At the discrete drop-off end 40 of the trays 14*a*-14*e*, the discrete articles 50 are provided to the guiding paths 16 in a quasi-uniform, spaced-apart manner.

In the embodiment shown, the discrete articles 50 travelling within each of the respective channels 36 are provided to a corresponding respective one of the guiding paths 16. Given that each of the five vibration trays 14*a*-14*e* includes four channels 36, the container filling machine 10 comprises a total of twenty channels 36, with each channel 36 leading into a respective one of the guiding paths 16. As such, there is a one-to-one ratio between channels 36 and the guiding paths 16. It should be appreciated that in an alternative embodiment, each of the vibration trays 14*a*-14*e* could include any number of channels 36 without departing from the spirit of the invention. In addition, two or more of the channels 36 could supply discrete articles 50 to a single guiding path 16. As such, it is not required that there be a one-to-one ratio of channels 36 to guiding paths 16.

Figure 5:
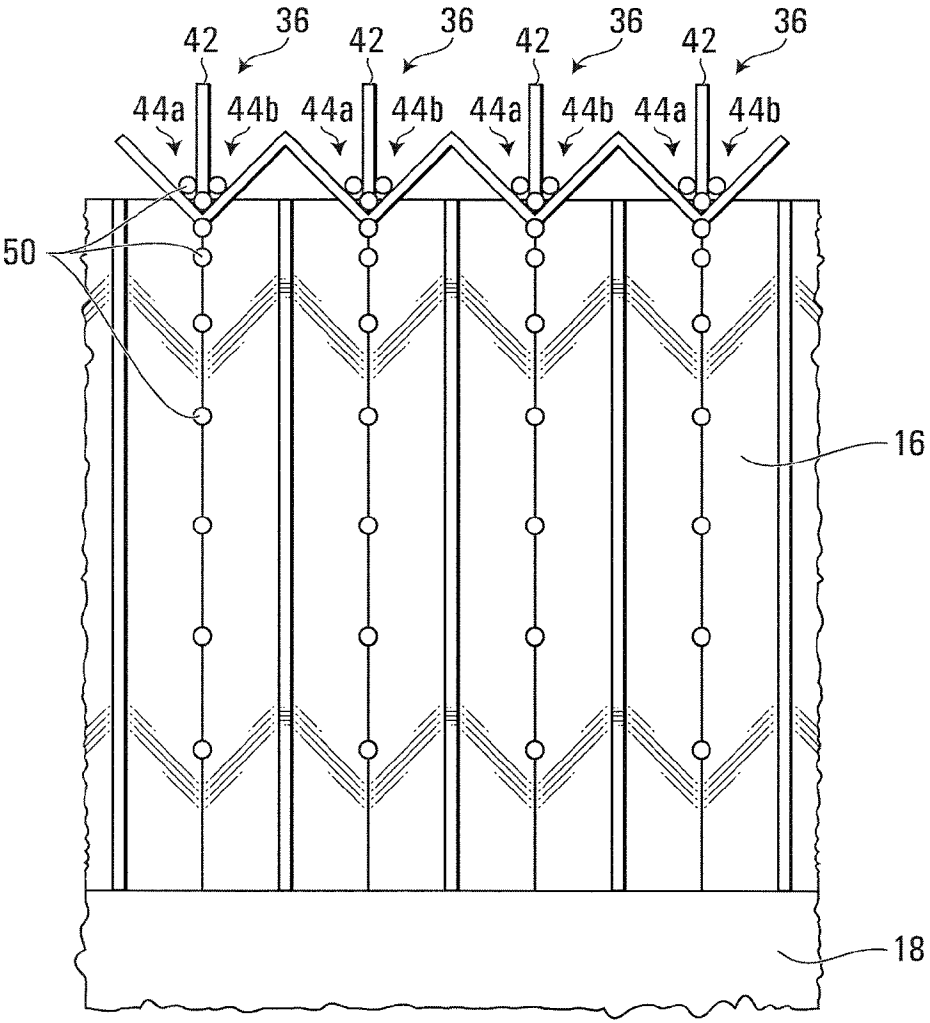
FIG. 5 shows a front plan view of a vibration tray and a plurality of corresponding guiding paths in accordance with the present invention.

Shown in FIGS. 4 and 5 is vibration tray 14*a*, which has been shown separately from vibration trays 14*b*-14*e* for the sake of simplicity. Vibration trays 14*b*-14*e* are the same as vibration tray 14*a*, and as such, anything described herein with respect to vibration tray 14*a* is also applicable to vibration trays 14*b*-14*e*.

As best shown in FIG. 5, the four channels 36 within vibration tray 14*a* are V-shaped channels. It should, however, be appreciated that other shapes of channels are also included within the scope of the present invention. For example, the channels 36 may be U shaped, or have flat bottoms, among other possibilities.

In accordance with the present invention, each of the channels 36 includes a wall-portion 42 that extends along a longitudinal length of the channel for dividing the channel 36 into a first side and a second side. As such, the wall portion 42 creates two discrete article receiving paths 40*a* and 40*b* within each channel 36. In the non-limiting embodiment shown, the wall portions 42 divide the channels 36 in half, such that the two discrete article receiving paths 44*a* and 44*b* are of equal size. However, in an alternative embodiment, the two discrete article receiving paths 44*a* and 44*b* could be of differing sizes.

The wall portions 42 can be of any height suitable for dividing the channels 36 into the two discrete article receiving paths 40*a* and 40*b*. For example, the height of the wall portions 42 can extend above, below, or to the same height as the upper edges of the channels 36.

At a location in proximity to the discrete article drop-off end 40, the two discrete article receiving paths 44*a* and 44*b* combine into a single discrete article-depositing path 46. This discrete article depositing path 46 is essentially the path of travel created by the channel 36 when no wall portion 42 is included therein.

It should be appreciated that the wall portions 42 can be made separately from the vibration tray 14*a*, and as such can be affixed to the vibration tray 14*a* in a removable manner or in a permanent manner, at a later stage of production. For example, in the case where the wall portions 42 are removably affixed to the vibration tray 14*a*, they can be affixed via screws, bolts, a snap-fit arrangement or a friction fit arrangement, among other possibilities. In a non-limiting example of implementation, the wall portions 42 include tabs that are adapted for being inserted within slots in the channels 36 for maintaining the wall portions 42 in position within the channels 36. In the case where the wall portions 42 are permanently affixed to the vibration tray 14*a*, they can be welded, adhered or riveted in place, among other possibilities. In yet a further alternative, the wall portions 42 can be integrally formed with the vibration tray 14, such that the arrangement of the tray 14*a* and the four wall portions 42 are formed as one piece. In this manner, the tray 14, as well as the wall portions 42 can be stamped, crimped, bent or molded into the appropriate shape.

As shown in FIG. 4, the wall portions 42 extend from the discrete article-receiving end 38 of the tray 14*a* towards the discrete article drop-off end 40 of the tray. However, the wall portions 42 do not extend all the way to the end of the discrete article drop-off end 40. As such, the two discrete article-receiving paths 44*a* and 44*b* are able to merge into the single discrete article-depositing path 46 at the wall termination 52.

The location of the wall termination 52 can vary depending on a variety of factors such as the size and weight of the discrete articles, the length of the tray 14*a* and the depth of the channels 36, among other possible factors. These factors will be known to a person of skill in the art, such that the best location for the wall portions 42 to terminate in order to optimize the flow of discrete articles through the channels 36 can be determined.

In operation, the discrete articles 50 from the hopper 12 are deposited onto the trays 14*a*-14*e* at the discrete article-receiving end 38. More specifically, the discrete articles 50 exit the hopper 12 onto guiding trays 13*a*-13*e* that direct the discrete articles into the two discrete article receiving paths 44*a* and 44*b* of each channel 36. As such, in the embodiment shown, the guiding trays 13*a*-13*e* include forty paths that direct the discrete articles into the two paths 44*a* and 44*b* of each of the twenty channels 36. In the embodiment shown, the guiding trays 13*a*-13*e* are slopped V-shaped channels that direct and position the discrete articles 50 from the hopper 12 into the discrete article receiving paths 44*a* and 44*b* of each channel 36.

As shown in FIG. 4, once the discrete articles 50 have been deposited within the two discrete article receiving paths 44*a* and 44*b* of each channel 36, the vibration of the vibration trays 14*a*-14*e* causes the discrete articles 50 to move towards the discrete article drop-off end 40. As the discrete articles 50 travel towards the discrete article drop-off end 40, they begin to move more closely together, as depicted in FIG. 4. As such, when the discrete articles 50 have reached the wall termination 52 of the wall portions 42, the discrete articles 50 are tightly packed such that they push each other into the single discrete article depositing path 46.

More specifically, as the two streams of discrete articles 50 (namely the stream in the first discrete article receiving path 44*a* and the stream in the second discrete article receiving path 44*b*) meet at the wall termination 52, the two streams merge into the single discrete article depositing path 46. This merging causes the discrete articles 50 in the two discrete article-receiving paths 44*a* and 44*b* to push the subsequent discrete articles 50 in the single discrete article depositing path 46 forwards. As such, due to this forced pressure, the discrete articles 50 within the single discrete article depositing path 46 move more quickly than the discrete articles in the two discrete article receiving paths 44*a* and 44*b*. This results in the vibration tray 14*a* supplying discrete articles 50 from the discrete article drop-off end 40 at a faster rate than if each channel 36 included only a single stream of discrete articles 50 all the way along its length. This is due at least in part to the fact that since there are two streams that feed into one single discrete article depositing path 46, 1) there is less space between each of the discrete articles 50 that exit the vibration tray 14*a* at the discrete article drop off end 40 and 2) the force from the merging of the two streams causes the discrete articles in the single discrete article depositing path 46 to move more quickly.

In certain instances, it has been found that by including the wall portions 42 within the channels 36 of the vibration trays 14*a*-14*e*, the number of discrete articles 50 exiting the discrete drop-off ends 40 of the vibration trays 14*a*-14*e* increases significantly. This, in turn, increases the overall container filling speed of the container-filling machine 10.

As mentioned above, and as shown in the non-limiting embodiment of FIGS. 1 and 2, each guiding tray 13*a*-13*e* and each vibration tray 14*a*-14*e* corresponds to a respective one of containers 30 to be filled. As such, the eight paths in each of guiding trays 13*a*-13*e* lead into four channels 36 of a corresponding vibration tray 14*a*-14*e* which, in turn, lead into four guiding paths 16 that lead into respective ones of the containers 30 to be filled. In the embodiment shown, every four guiding paths 16 leads into a respective container 30, such that the container filling machine 10 is able to simultaneously fill five containers 10.

Given that each one of the guiding trays 13*a*-13*e* and each one of the vibration trays 14*a*-14*e* corresponds to a respective container 30, and given that each one of the trays 13*a*-13*e* and 14*a*-14*e* can be controlled independently, the speed of vibration of one or more of the trays 13*a*-13*e* and 14*a*-14*e* can be adjusted in the case that its associated container 30 is being filled too rapidly or too slowly.

More specifically, given that there is one guiding tray 13*a*-13*e* and one vibration tray 14*a*-14*e* for each container 30 that is to be filled, each of the guiding trays 13*a*-13*e* and vibration trays 14*a*-14*e* can be controlled independently. As such, each one of the guiding trays 13*a*-13*e* and vibration trays 14*a*-14*e* can vibrate at a different frequency, for example. This independent control of the guiding trays 13*a*-13*e* and the vibration trays 14*a*-14*e* enables the container filling machine 10 to have better control over the number of discrete articles for personal treatment that are supplied to each container 30.

Figure 6:
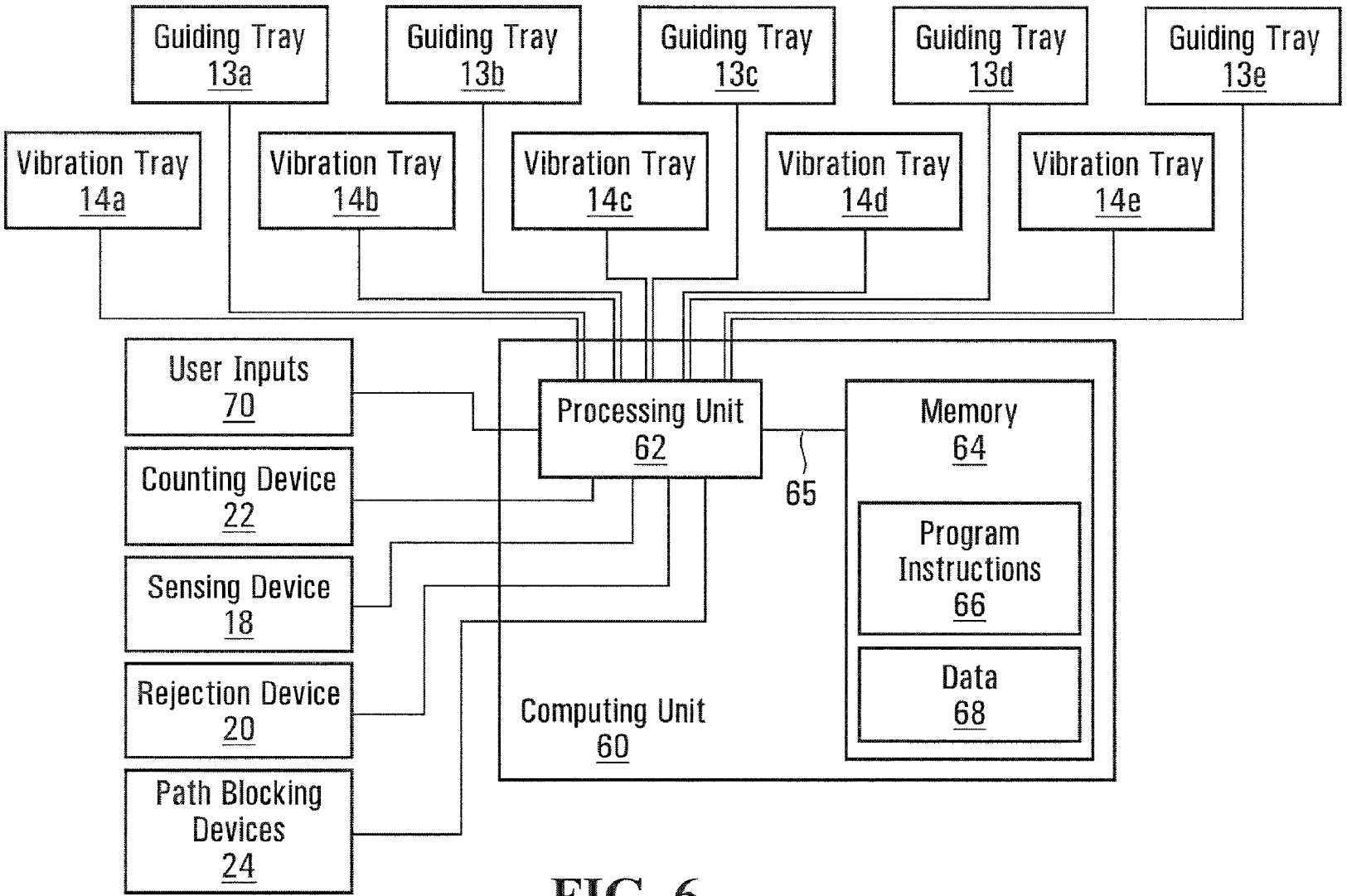
FIG. 6 shows a non-limiting block diagram of a computing unit suitable for controlling the functionality of the container filling machine of FIG. 1.

As mentioned above, the functionality of the components of the container filling machine 10 (the guiding trays 13*a*-13*e*, the vibration trays 14*a*-14*e*, the sensing device 18, the rejection device 20, the counting device 22 and the path blocking devices 24) are controlled via one or more computing units that include at least one software driven processing unit. For example, the computing unit 60 can be a computer (such as a PC, a laptop, etc. . . . ) that includes a processing unit. Shown in FIG. 6 is a non-limiting block diagram of a computing unit 60 suitable for controlling the different components of the container-filling machine 10. As shown, the computing unit 60 includes a processing unit 62 and a memory unit 64 that are in communication with each other via a communication bus 65. The memory unit 64 includes program instructions 66 and data 68 that are accessed and processed by the processing unit 62, such that the processing unit 62 can control the functionality and operations of the components of the container filling machine 10. As shown, the processing unit 62 is in communication with the guiding trays 13*a*-13*e*, the vibration trays 14*a*-14*e*, the sensing device 18, the rejection device 20, the counting device 22 and the path blocking devices 24. The processing unit 62 is also in communication with user inputs 70 that enable a user to enter commands and/or data into the computing unit 60. This can be done via a keyboard, a keypad, a mouse, a touch sensitive screen, or any other user operable input device.

In this non-limiting embodiment, all or part of the functionality of the guiding trays 13*a*, vibration trays 14*a*-14*e*, the sensing device 18, the rejection device 20, the counting device 22 and the path blocking devices 24 may be implemented as software consisting of a series of instructions for execution by the processing unit 62. For example, the series of instructions could be stored in the memory 64, which could be a medium which is fixed, tangible and readable directly by the processing unit 62 (e.g., removable diskette, RAM, flash memory, CD-ROM, ROM, PROM, EEPROM or fixed disk).

The computing unit 60 may comprise a number of interfaces for receiving or sending data elements to external devices. For example, the computing unit 60 can include an interface (not shown) for receiving signals from the user inputs 70. These user inputs may allow an operator of the container-filling machine 10 to enter commands and parameters for programming and/or controlling the different components of the container-filling machine 10. This may be done in order to change operational settings of the different components, and/or to enter specific data, such as a desired vibrational setting of each tray 14*a*-14*e*, the number of discrete articles for personal treatment per container, etc. . . . The computing unit 60 may further include an interface for releasing data to be displayed to a user on a display (not shown).

The processing unit 62 may be located on the body of the container filling machine 10, or alternatively, the processing unit 62 may be located remotely from the container filling machine 10, such as within a remotely located computer that is in electrical communication with the electrical circuitry of the components of the container filling machine 10.

It should be appreciated that the functionality of some of the components of the container-filling machine 10 is directly dependent on events that occur at other components of the container-filling machine 10. For example, the operation of the rejection device 20 is dependent on the detection at the sensing device 18 of a defective discrete article for personal treatment. Likewise, the operation of the path blocking devices 24 is at least partly dependent on the number of discrete articles for personal treatment counted by the counting device 22. As such, it is advantageous to have a single processing unit 62 in communication with each of the components (the sensing device 18, the rejection devices 20, the counting device 22 and the path blocking devices 24) such that the processing unit 62 can co-ordinate the operation of the different components.

However, in accordance with an alternative example of implementation, the guiding trays 13*a*-13*e*, the vibration trays 14*a*-14*e*, the sensing device 18, the rejection devices 20, the counting device 22 and the path blocking devices 24 may each include their own separate computing unit and/or processing unit. In such an embodiment, at least some of the processing units would be in communication with each other over a communication link, so as to co-ordinate the functionality of the different components. The manner in which the functionality of each of the sensing device 18, the rejection device 20, the counting device 22, and the path blocking devices 24 is controlled by one or more computing units 60, is described in more detail in co-pending PCT application PCT/CA2007/000238, and as such will not be described in more detail herein.

However, the manner in which the functionality of the guiding trays 13*a*-13*e* and the vibration trays 14*a*-14*e* is controlled, will now be described in more detail below.

In operation, the processing unit 62 may access the program instructions and data 68 contained in the memory 64 for issuing control signals to the drive units 56 and 57 positioned beneath each of the guiding trays 13*a*-13*e* and the vibration trays 14*a*-14*e* for setting the frequency of vibration of the guiding trays 13*a*-13*e* and the vibration trays 14*a*-14*e*. This may be done solely on the basis of the program instructions 66 and data 68, or the processing unit 62 may set the frequency of vibration on the basis of information specified by an operator via the user inputs 70. The processing unit 62 is in communication with the drive units 56 and 57 positioned beneath each of the guiding trays 13*a*-13*e* and the vibration trays 14*a*-14*e* in order to operate the drive units 56 for causing vibration of the vibration trays 14*a*-14*e*.

Figure 7:
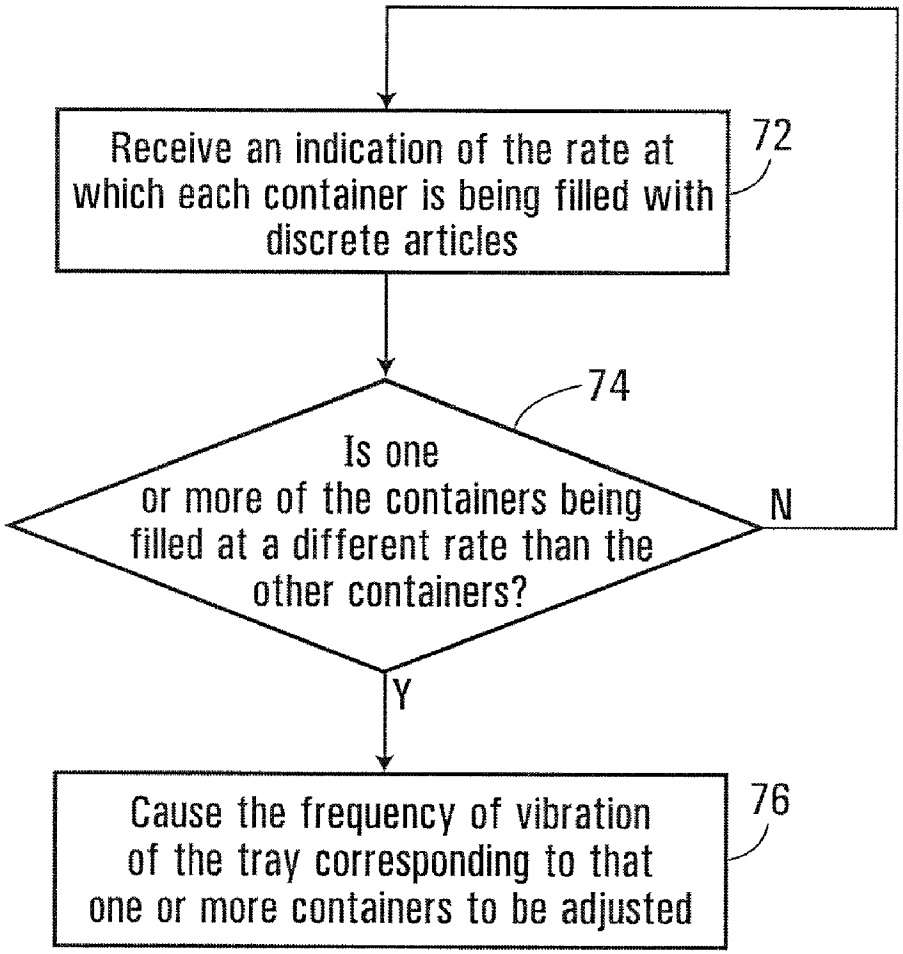
FIG. 7 shows a non-limiting flow diagram of a process used for controlling the vibration of the vibration trays in accordance with an example of implementation of the present invention.

Once the initial frequency of vibration of each of the guiding trays 13*a*-13*e* and vibration trays 14*a*-14*e* has been set (via the drive units 56, 57), the processing unit 62 can then cause adjustment of the frequency of vibration of each individual one of the guiding trays 13*a*-13*e* and the vibration trays 14*a*-14*e* on the basis of the rate at which each of the respective containers 30 is being filled. The manner in which the processing unit 62 controls the frequency of vibration of the guiding trays 13*a*-13*e* and the vibration trays 14*a*-14*e* will now be described in more detail with respect to the flow chart shown in FIG. 7.

Firstly, at step 72 the processing unit 62 receives an indication of the rate at which each container 30 is being filled with discrete articles. This step can be done in a variety of different manners. For example, in accordance with a first non-limiting example, the processing unit 62 can receive an indication from the counting device 22 of the number of discrete articles travelling along each of the respective guiding paths 16 and passing through the counting device 22. The counting device 22 includes circuitry along each guiding path 16 for detecting when a discrete article passes there along. The counting device 22 thus detects and counts the discrete articles travelling along each guiding path 16 and provides this information to the processing unit 62.

As such, on the basis of the number of discrete articles, and the time period in which those discrete articles travel through the counting device 22, the processing unit 62 can determine the rate at which each container 30 is being filled. It should be appreciated that the information from the counting device 22 indicative of the number of discrete articles can be provided on a continuous basis in substantially real time, or the counting device 22 can provide the information indicative of the number of discrete articles to the processing unit 62 at predetermined time intervals.

In accordance with a second non-limiting embodiment, the processing unit 62 can receive an indication of the rate at which each container is being filled based on weight readings associated with each container. In such an embodiment, the container filling machine 10 is in communication with a plurality of scales (or other weight measuring devices) that are positioned respectively beneath each of the containers 30 that are being filled. In this manner, based on the rate at which the weight of each container 30 increases, the processing unit 62 can determine the rate at which the containers 30 are being filled.

At step 74, on the basis of the information indicative of the rate at which each container is being filled, the processing unit 62 determines whether one or more of the containers 30 is being filled at a different rate (whether faster or slower) than the other containers 30. In order to have the filling of the containers occur at approximately the same time, it is desirable to have the rate at which the containers are being filled to be substantially the same.

The manner in which the processing unit 72 determines whether one of the containers 30 is being filled at a different rate than the other containers can be done in a variety of different manners. For example, this determination can be made by comparing the rates at which the individual ones of the containers 30 are being filled. The comparison may be made based on the absolute rate of each container, or the comparison may be made based on an average rate, mean rate or median rate at which the containers 30 are being filled. In yet a further example, the comparison may be made against a range of predetermined rates that are pre-programmed into the memory 64 of the computing unit 60. These predetermined rates may be programmed into the memory 64 by a manufacturer of the container-filling machine 10, or alternatively, these predetermined rates may be entered into the memory 64 by an operator of the machine via the user inputs 70. In this manner, an operator of the machine can determine a range of rates at which the container-filling machine 10 should fill the containers 30. As such, if the rate at which one or more of the containers 30 is being filled falls outside of the pre-determined range, then the processing unit 62 will determine that that container is being filled at a different rate than the other containers 30.

When the containers are all being filled at substantially same rate as the other containers, the process loops between steps 72 and 74 of receiving information indicative of the rate at which the containers are being filled, and performing the determination described above. However, in the case where the processing unit 62 determines that one or more of the containers is being filled at a different rate than the other containers, then the processing unit 62 proceeds to step 76. At step 76, the processing unit causes adjustment of the frequency of vibration of one or both of the guiding tray and the vibration tray corresponding to the container that is being filled at a different rate than the other containers 30. The frequency of vibration of the guiding trays 13*a*-13*e* and the vibration trays 14*a*-14*e* can be adjusted by controlling the drive units 56, 57 positioned below the respective guiding trays 13*a*-13*e* and vibration trays 14*a*-14*e*.

As such, if the container that is being filled at a different rate is being filled more slowly than the other containers 30, then the processing unit 62 can cause an increase in the frequency of vibration of the guiding tray and the vibration tray associated with that container. As such, that guiding tray and the vibration tray will then supply the discrete articles to the container at a faster rate. However, if the container that is being filled at a different rate is being filled more quickly than the other containers 30, then the processing unit 62 can decrease the frequency of vibration (or stop the vibration altogether) of the guiding tray and vibration tray associated with that container. As such, the guiding tray and the vibration tray supplying discrete articles to that container will do so at a slower rate. In this manner, the processing unit 62 is able to manage the rates at which the containers 30 are being filled, such that they can all be filled at substantially the same rate.

For the sake of example, let us assume that the container 30 that corresponds to guiding tray 13*b* and vibration tray 14*b* is being filled at a slower rate than the other containers 30. In such an embodiment, upon detection that that container 30 is being filled at a slower rate than the other containers 30, the processing unit 62 will issue a control signal to each of the drive units 57 and 56 that are positioned beneath guiding tray 13*b* and vibration tray 14*b* such that the frequency of vibration of both the guiding tray 13*b* and the vibration tray 14*b* increases.

Now let us assume that the container 30 that corresponds to guiding tray 13*b* and vibration tray 14*b* is being filled at a faster rate than the other containers 30. In such an embodiment, upon detection that that container 30 is being filled at a faster rate than the other containers 30, the processing unit 62 will issue a control signal to each of the drive units 57 and 56 that are positioned beneath guiding tray 13*b* and vibration tray 14*b* such that the frequency of vibration of both the guiding tray 13*b* and the vibration tray 14*b* decreases. In some embodiments, it may be desirable to stop the vibration of the guiding tray 13*b* completely, such that no more discrete articles are supplied to the vibration tray 14*b*. In this manner, the container filling machine 10 can quickly slow down the rate at which the discrete articles are being supplied to that container.

It should be noted that the control of both of the guiding trays 13*a*-13*e* and the vibration trays 14*a*-14*b* should be taken into consideration when trying to increase or decrease the rate at which the containers are being filled. For example, if it is desirable to decrease the rate at which the container 30 that corresponds to guiding tray 13*b* and vibration tray 14*b* is filled, it is not sufficient to simply decrease the frequency of vibration of the vibration tray 14*b*. This will simply cause discrete articles to pile up within vibration tray 14*b* since the rate at which discrete articles from guiding tray 13*b* are being supplied to the vibration tray 14*b* does not change.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A method for filling at least one container with discrete articles, said method comprising:

a) providing at least one vibration tray comprising:

i) a discrete article receiving end;

ii) a discrete article drop-off end;

iii) a plurality of channels extending between the discrete article receiving end and the discrete article drop-off end, each channel including a wall-portion that divides the channel in two along at least a portion of a longitudinal length of the channel, thereby creating within the channel a first side and a second side, wherein at a pre-determined distance from said discrete article drop-off end the wall-portion terminates such that discrete articles moving within the first side of the channel and discrete articles moving within the second side of the channel merge into a single stream of discrete articles within the channel;

b) depositing the discrete articles onto the discrete article receiving end of the vibration tray such that the discrete articles are positioned within both the first side and the second side of each channel;

c) causing said vibration tray to vibrate in order to move the discrete articles from the discrete article receiving end towards said discrete article drop-off end along the first side and the second side of each channel;

d) providing a plurality of sloped paths for receiving the discrete articles from the discrete article drop-off end of said at least one vibration tray, said plurality of sloped paths leading the discrete articles towards at least one container to be filled.

2. A method as defined in claim 1, wherein the wall-portion within each channel extends from said discrete article receiving end towards said discrete article drop-off end.

3. A method as defined in claim 2, wherein said plurality of channels are V-shaped channels.

4. A method as defined in claim 2, wherein said wall-portions are removably attached to the at least one vibration tray.

5. A method as defined in claim 2, wherein the at least one vibration tray is one of a plurality of vibration trays, each of the plurality of vibration trays being controlled independently.

6. A method as defined in claim 5, wherein each vibration tray in the plurality of vibration trays corresponds to a respective container to be filled.

7. A container filling machine for placing discrete articles within at least one container, said container filling machine comprising:

a) at least one vibration tray comprising:

i) a discrete article receiving end;

ii) a discrete article drop-off end, the vibration tray being operative for moving discrete articles from said discrete article receiving end towards said discrete article drop-off end;

iii) a plurality of channels extending between said discrete article receiving end and said discrete article drop-off end, each channel including a wall-portion that divides the channel in two along at least a portion of a longitudinal length of the channel, thereby creating within the channel a first side and a second side, wherein at a pre-determined distance from said discrete article drop-off end the wall-portion terminates such that discrete articles moving within the first side of the channel and discrete articles moving within the second side of the channel merge into a single stream of discrete articles within the channel;

b) a plurality of sloped paths for receiving the discrete articles from the discrete article drop-off end of said at least one vibration tray, said plurality of sloped paths leading the discrete articles towards the at least one container.

8. A container filling machine as defined in claim 7, wherein said wall-portion within each channel extends from said discrete article receiving end towards said discrete article drop-off end.

9. A container filling machine as defined in claim 8, wherein said plurality of channels are V-shaped channels, wherein said wall-portion within each channel extends from the base of the V-shaped channel.

10. A container filling machine as defined in claim 8, further comprising a discrete article dispensing device for depositing the discrete articles onto said discrete article receiving end of said at least one vibration tray such that the discrete articles are positioned within both the first side and the second side of each channel.

11. A container filling machine as defined in claim 7, wherein said wall-portions are removably attached to said at least one vibration tray.

12. A container filling machine as defined in claim 7, wherein said at least one vibration tray is one of a plurality of vibration trays, each of said plurality of vibration trays being controlled independently.

13. A container filling machine as defined in claim 12, wherein each vibration tray corresponds to a respective container to be filled.

14. A container filling machine as defined in claim 7, wherein as the discrete articles merge from the first side of the channel and the second side of the channel into the single stream of discrete articles within the channel, the single stream of discrete articles is caused to travel more quickly along the channel than the discrete articles within the first side of the channel and the second side of the channel.

15. A vibration tray for use within a container filling machine that is operative for placing discrete articles within at least one container, said vibration tray comprising:

a) a discrete article receiving end for receiving discrete articles;

b) a discrete article drop-off end, the vibration tray being operative for moving discrete articles from said discrete article receiving end towards said discrete article drop-off end;

c) a plurality of channels extending between said discrete article receiving end and said discrete article drop-off end, each channel including a wall-portion that divides the channel in two along at least a portion of a longitudinal length of the channel, thereby creating within the channel a first side and a second side, wherein at a pre-determined distance from said discrete article drop-off end the wall-portion terminates such that discrete articles moving within the first side of the channel and discrete articles moving within the second side of the channel merge into a single stream of discrete articles within the channel.

16. A vibration tray as defined in claim 15, wherein said wall-portion within each channel extends from said discrete article receiving end towards said discrete article drop-off end.

17. A vibration tray as defined in claim 15, wherein said plurality of channels are V-shaped channels, wherein the wall-portion within each channel extends from the base of the V-shaped channel.

18. A vibration tray as defined in claim 15, wherein the wall-portion within each channel is removably attached to said vibration tray.

19. A vibration tray as defined in claim 15, wherein said vibration tray is one of a plurality of vibration trays, each of said plurality of vibration trays being controlled independently.

20. A vibration tray as defined in claim 19, wherein each of said plurality of vibration trays corresponds to a respective container to be filled.

21. A vibration tray as defined in claim 15, wherein the single stream of discrete articles within the channel travel more quickly than the discrete articles moving within the first side of the channel and the second side of the channel.

* * * * *